US012686824B2

(12) United States Patent
Baudner et al.

(10) Patent No.: US 12,686,824 B2
(45) Date of Patent: Jul. 21, 2026

(54) PROCESS AND INSTALLATION FOR THE PRODUCT PROCESSING OF FISCHER-TROPSCH BASED RAW PRODUCTS FOR THE PRODUCTION OF PRE-FORMULATED FUELS OR STANDARD-COMPLIANT FUELS

(71) Applicant: INERATEC GMBH, Karlsruhe (DE)

(72) Inventors: Julian Baudner, Karlsruhe (DE); Manuel Selinsek, Karlsruhe (DE)

(73) Assignee: INERATEC GMBH, Karlsruhe (DE)

( * ) Notice: Subject to any disclaimer, the term of this patent is extended or adjusted under 35 U.S.C. 154(b) by 502 days.

(21) Appl. No.: 18/034,264

(22) PCT Filed: Oct. 14, 2021

(86) PCT No.: PCT/EP2021/078508
§ 371 (c)(1),
(2) Date: Apr. 27, 2023

(87) PCT Pub. No.: WO2022/089955
PCT Pub. Date: May 5, 2022

(65) Prior Publication Data

US 2023/0383193 A1 Nov. 30, 2023

(30) Foreign Application Priority Data

Oct. 30, 2020 (EP) ..... 20204893

(51) Int. Cl.
*C10G 2/00* (2006.01)
*C10G 69/04* (2006.01)
*C10K 3/02* (2006.01)

(52) U.S. Cl.
CPC ..... *C10G 2/34* (2013.01); *C10G 2/32* (2013.01); *C10G 69/04* (2013.01); *C10K 3/026* (2013.01); *C10G 2400/02* (2013.01); *C10G 2400/04* (2013.01); *C10G 2400/08* (2013.01)

(58) Field of Classification Search
CPC . C10G 2/34; C10G 2/32; C10G 69/04; C10G 2400/02; C10G 2400/04; C10G 2400/08; C10G 45/58; C10G 47/00; C10G 65/12; C10K 3/026
See application file for complete search history.

(56) References Cited

U.S. PATENT DOCUMENTS

| | | | |
|---|---|---|---|
| 6,306,917 | B1 | 10/2001 | Bohn et al. |
| 8,106,102 | B2 | 1/2012 | Steynberg et al. |
| 2007/0010590 | A1 | 1/2007 | Abbott et al. |

(Continued)

FOREIGN PATENT DOCUMENTS

| | | | |
|---|---|---|---|
| CL | 200101295 | A1 | 6/2001 |
| CL | 201201299 | A1 | 8/2012 |

(Continued)

*Primary Examiner* — Jafar F Parsa
(74) *Attorney, Agent, or Firm* — Abel Schillinger, LLP

(57) ABSTRACT

Processes and installations for the production of standard-compliant fuels, preferably gasoline (according to EN 228), diesel (according to EN 590 or EN 15940) and kerosene (according to ASTM D7566 or ASTM D1566), starting from $CO_2$ and $H_2$ by an integrated processing of Fischer-Tropsch raw products via different process steps with recycling of hydrogen or hydrogen-containing gases remaining after the processing into the RWGS before the Fischer-Tropsch synthesis.

18 Claims, 5 Drawing Sheets

(56) References Cited

U.S. PATENT DOCUMENTS

| | | | |
|---|---|---|---|
| 2012/0238645 | A1 | 9/2012 | Ruedlinger |
| 2013/0149767 | A1 | 6/2013 | Marion et al. |

FOREIGN PATENT DOCUMENTS

| | | | |
|---|---|---|---|
| CL | 202000476 | A1 | 8/2020 |
| DE | 102019200245 | A1 | 7/2020 |
| EP | 3670443 | A1 | 6/2020 |
| JP | 200716090 | A | 1/2007 |
| WO | 2004096952 | A1 | 11/2004 |
| WO | 2007031668 | A1 | 3/2007 |

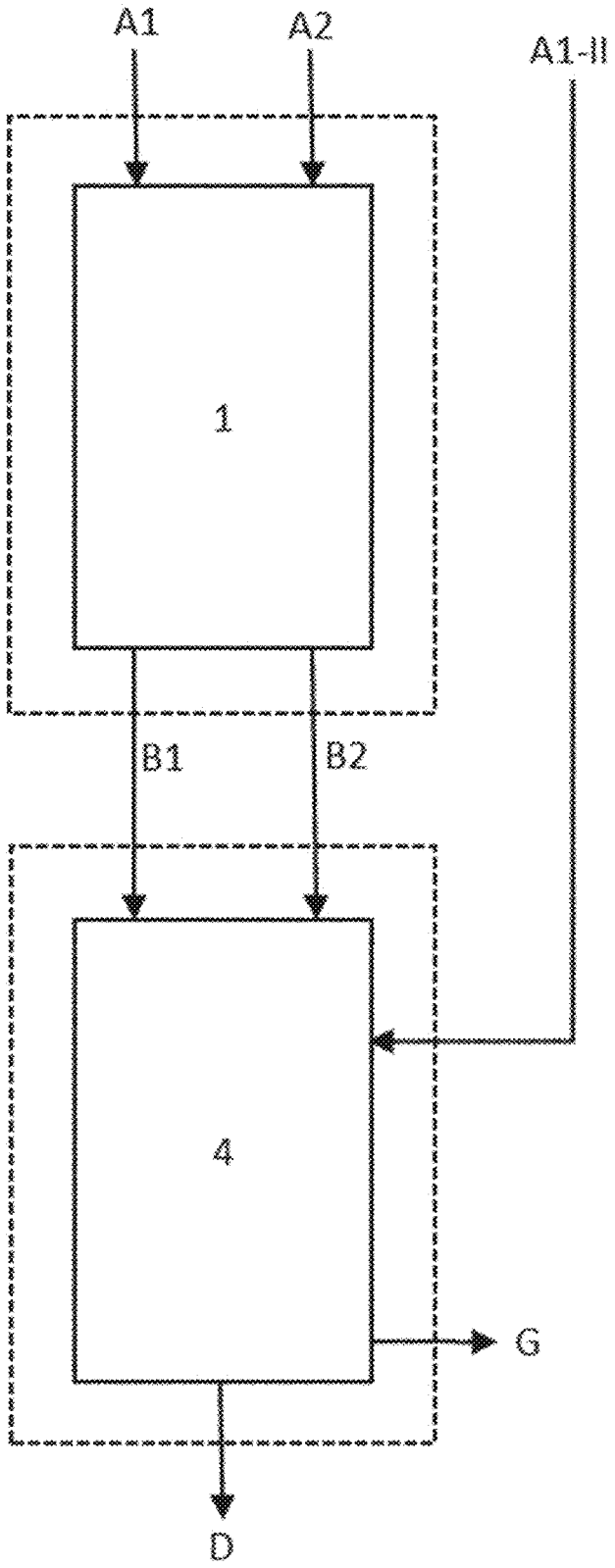
Fig. 2a - Prior Art

PROCESS AND INSTALLATION FOR THE PRODUCT PROCESSING OF FISCHER-TROPSCH BASED RAW PRODUCTS FOR THE PRODUCTION OF PRE-FORMULATED FUELS OR STANDARD-COMPLIANT FUELS

SUMMARY OF THE INVENTION

All documents cited in the present application are incorporated by reference in their entirety into the present disclosure (=incorporated by reference in their entirety).

BACKGROUND OF THE INVENTION

1. Field of the Invention

The present invention relates to processes and installations for the production of standard-compliant fuels, such as diesel or kerosene, by an integrated processing of Fischer-Tropsch raw products (in particular oil and wax) through various process steps and corresponding installations.

2. Discussion of Background Information

The Fischer-Tropsch synthesis (FTS) process used to produce hydrocarbons has been known for many decades. In this process, a synthesis gas consisting mainly of carbon monoxide (CO) and hydrogen ($H_2$) is converted to hydrocarbons by heterogeneous catalysis in a synthesis reactor. In the outlet stream of Fischer-Tropsch synthesis units, in which synthesis gas is synthesised into hydrocarbons according to the Fischer-Tropsch process, four fractions can usually be distinguished:

A gas phase consisting of non-converted synthesis gas (mainly CO, $H_2$), short-chain hydrocarbons and volatile components of the by-products as well as $CO_2$.

A waxy phase of long-chain hydrocarbons that is solid at ambient temperature and pressure (wax phase).

A hydrophobic phase of shorter chain hydrocarbons that is liquid at ambient temperature and pressure (oil phase).

An aqueous phase of forming reaction water and organic compounds dissolved therein.

Processes are known in which the wax and oil phases produced by the Fischer-Tropsch synthesis are processed by hydrogen treatment by means of so-called hydrotreatment in refineries to produce standard-compliant fuel products such as gasoline, diesel or kerosene.

WO 2007/031668 A1 describes a recycling of gases from the upgrading unit into the Fischer-Tropsch reactor, the recycled gases are directly fed into the Fischer-Tropsch stage. U.S. Pat. No. 6,306,917 B1 describes the recycling of the hydrotreatment gases to the synthesis gas production, whereby a purification of the gases is provided. U.S. Pat. No. 8,106,102 B2 describes the recycling of hydrogen from the hydrotreatment into the Fischer-Tropsch stage. WO 2004/096952 A1 describes the recycling of the gases from the processing, using separation stages. DE 10 2019 200245 A1 discloses the separation of Fischer-Tropsch products and the recycling of the gaseous fractions into a reformer.

A problem of the prior art is that decentralised, climate-neutral energy generation concepts are often based on direct on-site conversion to liquid and/or solid energy carriers of high energy densities for loss-reducing transport or intermediate storage of these renewable energies. A fuel-oriented use of these climate-neutral energy carriers requires a subsequent processing into standard-compliant fuels, which usually takes place in refineries. However, a conventional processing in refineries is based on very high throughputs, due to which only a so-called co-processing of the decentrally produced Fischer-Tropsch products, which are limited in terms of throughput, is possible. This only leads to the possibility of a climate-neutral blending rate of the refinery product. To produce a completely climate-neutral fuel according to the current state of the art, therefore, either the construction of a refinery adapted to the production capacity of the Fischer-Tropsch synthesis or a direct, decentralised processing of the Fischer-Tropsch raw products to standard-compliant fuels is necessary.

Furthermore, according to the current state of the art, it is problematic that conventional and processing methods already researched in detail such as hydrocracking, hydrogenation and isomerisation require a very high input of hydrogen, due to which these methods in conventional petroleum refineries are often coupled with processes in which hydrogen is produced for economic reasons. The construction of an independent installation for processing Fischer-Tropsch products to standard-compliant fuels would make economic operation increasingly difficult due to the high hydrogen demand.

Therefore, there is still considerable potential for improvement based on the current state of the art.

OBJECT

Accordingly, the object of the present invention was to provide processes and devices which no longer exhibit the problems of the prior art, or at least only to a greatly reduced extent, or which exhibit new advantageous effects.

Further object will become apparent from the following description.

SOLUTION

These and other tasks within the scope of the present invention are solved by the objects of the independent claims.

Preferred embodiments result from the dependent claims as well as the following description.

DEFINITIONS OF TERMS

In the context of the present invention, all indications of quantity are to be understood as indications of weight, unless otherwise indicated.

In the context of the present invention, the term "ambient temperature" means a temperature of 20° C. Temperature indications are in degrees Celsius (° C.) unless otherwise indicated.

Unless otherwise stated, the reactions or process steps indicated are carried out at ambient pressure (=normal pressure/atmospheric pressure), i.e., at 1013 $mbar_a$.

In the context of the present invention, the term "long-chain hydrocarbons" is understood to mean hydrocarbons with at least 25 carbon atoms ($C_{25}$). The long-chain hydrocarbons having at least 25 carbon atoms may be linear or branched. Usually, the long-chain hydrocarbons reach chains with about 100 carbon atoms. Under special reaction conditions, even longer chains can be formed.

In the context of the present invention, the term "shorter-chain hydrocarbons" is understood to mean hydrocarbons with 5 to 24 carbon atoms ($C_5$-$C_{24}$). The shorter chain hydrocarbons with 5 to 24 carbon atoms may be linear or branched.

In the context of the present invention, the term "short-chain hydrocarbons" is understood to mean hydrocarbons having 1 to 4 carbon atoms ($C_1$-$C_4$). The short-chain hydrocarbons with 4 carbon atoms may be linear or branched.

In the context of the present invention, the term "wax phase" is understood to mean that product phase of the Fischer-Tropsch synthesis which is characterised by long-chain hydrocarbons. In individual cases, subordinate amounts of other compounds may be present in less than 10% by weight, in particular less than 5% by weight. This is known to the person skilled in the art and requires no further explanation.

In the context of the present invention, the term "oil phase" is understood to mean that product phase of the Fischer-Tropsch synthesis which is characterised by shorter-chain hydrocarbons. In individual cases, subordinate amounts of other compounds may be present in less than 10% by weight, in particular less than 5% by weight. This is known to the person skilled in the art and requires no further explanation.

In the context of the present invention, standard-compliant fuels are understood to be fuels which can be used in compliance with the respective legal standards, i.e., which fulfil the parameters of the respective standards. Depending on the currently applicable legal provisions, this may change. In particular, such standards are EN 228 for gasoline, EN 590 or EN 15940 for diesel and ASTM D7566 or ASTM D1566 for kerosene.

In the context of the present invention, "Fischer-Tropsch" is occasionally abbreviated to "FT" for convenience.

In the context of the present invention, "Reverse Water Gas Shift Reaction" is sometimes abbreviated to "RWGS" for convenience, and correspondingly, the device/unit in which the RWGS occurs is sometimes referred to as "RWGS" for convenience, also.

In the context of the present invention, "hydrotreatment unit" is occasionally abbreviated to "HTE" for convenience.

In the context of the present invention, the terms "installation" and "device" are occasionally used interchangeably.

In the context of the present invention, a power-to-liquid (PtL) installation or a power-to-liquid process in the narrower sense, is understood to mean a installation or a process, respectively, in which in which $CO_2$ together with hydrogen, in particular electrolytically obtained hydrogen, is converted into the target products oil phase and wax phase, whereby in addition to the target products a gas fraction with light, short-chain hydrocarbons ($C_1$-$C_4$) and residual gases (CO, $CO_2$, $H_2$) as well as an aqueous phase with dissolved oxygen-containing hydrocarbons (by-products including alcohols, organic acids) may occur.

In a broader sense, the term also includes the subsequent processing or processing unit of the wax and/or oil phase to standard-compliant fuels.

In the context of the present invention, the term "consisting of" is to be interpreted such as to refer to essential parts of a device or essential steps of a process. It is understood that common parts such as screws, pipe connectors, sleeves and so on may (or must) be present, even if they are not explicitly mentioned.

DETAILED DESCRIPTION

The present invention relates to processes and devices for the production of standard-compliant fuels, preferably gasoline (according to EN 228), diesel (according to EN 590 or EN 15940) and kerosene (according to ASTM D7566 or ASTM D1566), particularly preferably diesel or kerosene, by an integrated processing of Fischer-Tropsch raw products (oil and wax) via various process steps.

In some variants of the present invention, the synthesis gas as the starting point of the Fischer-Tropsch synthesis originates from gasification of biomass, from synthesis gas generation from fossil educts (natural gas, crude oil, coal) or from electricity-based processes (conversion of electrolytically generated $H_2$ as well as $CO_2$ into storable products).

The FT synthesis unit to be used in the present invention is usually based on two stages arranged in sequence: in the first stage, an RWGS (reverse water gas shift reaction) takes place and in the second stage, the actual FT conversion takes place.

In the RWGS, carbon dioxide ($CO_2$) is converted with hydrogen ($H_2$) to carbon monoxide (CO) and water ($H_2O$). In preferred embodiments of the present invention, the contained hydrogen is not completely converted in order to be able to use it as reactant in the subsequent FT unit. Therefore, $H_2$ is preferably fed in excess into the RWGS.

In the context of the present invention, the synthesis gas obtained in the RWGS may comprise $CO_2$ and $CH_4$, as well as possibly other impurities, in addition to CO and $H_2$ or CO, $H_2O$ and $H_2$. In particular, if the gas recycled from the processing in addition to hydrogen still contains $C_1$- to $C_4$-hydrocarbons.

The mixture comprising CO and $H_2$ or CO, $H_2O$ and $H_2$ produced in the RWGS is then fed into the FT unit as a reactant stream.

By an extension of the Fischer-Tropsch synthesis unit with an additional, stand-alone processing stage, which in some embodiments of the present invention includes conventional processing steps such as hydrocracking, hydrogenation, isomerisation and fractionation, the FT product can be processed directly into standard-compliant fuels directly at the site of the FT synthesis unit, thus realising direct utilisation.

In order to minimize the high hydrogen demand in the processing stage, this unit is process-technically coupled with the Fischer-Tropsch synthesis unit in the context of the present invention and a material utilisation of the processing off-gas is realised in the RWGS of the Fischer-Tropsch synthesis unit. By this conduction of the process the hydrogen feed of the Fischer-Tropsch unit can be reduced since non-converted hydrogen from the processing installation arrives by a recycle via RWGS at the inlet of the FT unit. Thus, the hydrogen excess necessary for the processing reactions can be realised without any problems. Thus, to some extent a feed gas metering of the FT unit via the coupled processing unit takes place.

In the present invention, with this interconnection the off-gases of the processing unit are thus fed into the synthesis gas production process. This addresses the problem that here, too, a high $H_2$ content is required in order to turn the supplied $CO_2$ into carbon monoxide.

In the present invention, this synthesis gas production is effected by a reverse water gas shift reaction (RWGS).

In contrast to the prior art, in the context of the present invention the hydrogen-containing off-gases from the HT unit are used in order to produce synthesis gas in an RWGS.

Accordingly, in the context of the present invention, recycled gases are added to the synthesis gas production.

In the context of the present invention, a purification when recycling the hydrotreatment off-gases into the synthesis gas production is not necessary, in particular, no separation stages are necessary.

A particular feature of the present invention is the direct introduction of the hydrogen-containing off-gases from the hydrotreatment into the RWGS.

By the direct introduction of the off-gases, different gas separation devices can be avoided within the context of the present invention. At the same time, the use of (fresh) hydrogen in the RWGS can be substantially reduced, since the concentration of hydrogen in the hydrotreatment unit is very high and the conversion is relatively low.

It has been shown in the context of the present invention that the interconnection and the process according to the invention effect particularly advantageous results.

In the context of the present invention, the hydrotreatment unit comprises as different processing steps in some embodiments at least hydrocracking, hydrogenation and isomerisation. This enables the production of standard-compliant fuels such as diesel or kerosene from the products discharged from a Fischer-Tropsch installation.

A preferred embodiment of the present invention can be described as follows: The wax phase discharged from the FT synthesis is conveyed to a feed tank of the hydrotreatment unit (HTE) and from there, together with added hydrogen, is converted to shorter-chain hydrocarbons in a hydrocracking reactor. In a separator arrangement, which in preferred variants can be multi-stage, non-converted wax is separated in a first hot separator. In preferred variants, this can be returned to the feed tank in the form of a wax recycle, whereby complete elimination of the wax fraction can take place. In a cold separator, the produced shorter-chain hydrocarbons are separated from the remaining gas stream and conveyed to an oil feed tank of the HTE. The remaining gas stream, comprising non-converted hydrogen and by-products of the cracking reaction, mainly short-chain hydrocarbons such as methane and ethane, is fed to the off-gas of the HTE.

The oil phase discharged from the FT synthesis unit is also conveyed to an oil feed tank of the HTE and mixed there with the shorter chain products of the hydrocracking reaction. The mixed oil phase is then separated into the desired fractions in a separation unit. In one variant of the present invention, this separation is carried out by distillation. By means of an internal recycling to the wax feed tank of the HTE, the long-chain portion of the oil phase resulting from the upper boiling end of the product fractions can be fed to the hydrocracker and thereby also eliminated.

The light oil fraction resulting from the separation unit, which is preferably composed of $C_5$- to $C_{10}$-hydrocarbons, can be removed from the HTE as crude gasoline, so-called naphtha, or processed within the HTE, preferably by additional processing steps, such as and therefore preferred isomerisation, to higher octane naphtha. A target fraction separated by the separation unit can also be processed in an isomerisation and hydrogenation unit to produce standard-compliant fuel. For this purpose, a high input of hydrogen is necessary due to the reaction.

In variants, the fuel can be separated from the gas phase in at least one downstream separator and the remaining gas stream, comprising non-converted hydrogen and by-products of the isomerisation and hydrogenation unit, can be fed to the off-gas of the HTE.

The off-gas of the entire HTE, comprising non-converted hydrogen from the hydrocracking unit and the isomerisation and hydrogenation unit and short-chain hydrocarbons from side reactions of said processing units, is added to the synthesis gas production in the context of the present invention in the form of a gas recycle of the RWGS.

In preferred embodiments of the present invention, the processes within the HTE comprise temperatures between 50 and 350° C., preferably between 100 and 300° C., pressures up to 70 bar, in particular up to 50 bar and are carried out with noble metal, in particular platinum and/or palladium supported on alumina, or zeolites. It is known to the person skilled in the art in this context that a wide range of temperatures and pressures is possible in the processes themselves, depending on the desired products.

In preferred embodiments, the process conditions for an isomerisation are: catalyst=Pt/gamma-$Al_2O_3$, ratio $H_2/CH_2$=2, isomerization temperature 240° C., pressure=20 bar.

Subject matter of the present invention is, in particular, a device for the production of standard-compliant fuels comprising A) an optional unit for providing a $CO_2/H_2$ mixture B) a Fischer-Tropsch synthesis unit comprising or consisting of:

at least one RWGS stage configured for the reaction of $CO_2$ and $H_2$ to synthesis gas, wherein the synthesis gas comprises CO and $H_2$ or CO and $H_2$ and $H_2O$, and optionally $CO_2$ and $CH_4$, at least one Fischer-Tropsch stage configured for the reaction of synthesis gas comprising CO and $H_2$ in a Fischer-Tropsch synthesis C0) optionally at least one discharge device for product streams originating from the Fischer-Tropsch synthesis, C) processing unit configured for receiving and processing Fischer-Tropsch products discharged from the synthesis unit, in particular the wax phase and the oil phase, comprising or consisting of at least one of the following three sub-units:

i) isomerization unit, ii) cracking unit, preferably hydrocracking unit, iii) hydrogenation unit, optionally, but preferably, at least one separation unit, at least one feed line for hydrogen, one or more discharge lines, each configured for the discharge of a fraction containing a standard-compliant fuel in each case, optionally a discharge line for an aqueous phase, preferably a discharge line for an aqueous phase, and at least one discharge line for formed gases comprising hydrogen and $C_1$- to $C_4$-hydrocarbons, characterized in that the discharge line for the formed gases is designed as a recycle line for the gases into the RWGS, and in that the device does not comprise a purification device for the gases formed in the processing unit which are recycled to the synthesis unit RWGS.

It is essential for the present invention that the synthesis unit and the processing unit are located in relative proximity to each other, so that the recycling of the hydrogen-containing gases formed in the processing unit to the synthesis unit can be done by means of apparatuses.

Although in principle a pipeline would also be suitable for this gas recycling, this would not negatively affect the hydrogen saving effect of the present invention, but would cancel out the advantages due to increased energy expenditure.

In this respect, it is preferred in the context of the present invention if the synthesis unit and the processing unit are located on the same site, preferably in such a way that the recycling line has to be less than 10 m long. In particular, it is preferred if the synthesis unit and the reprocessing unit are located directly next to each other with a distance of less than 1 m, or even in one housing.

The discharge device for product streams C0) originating from the Fischer-Tropsch synthesis can be configured or designed in various ways. It is possible to design it in such a way that all product streams can be diverted. It is also possible that only individual product streams can be discharged. And it is also possible that a part of the respective product streams is discharged and the rest is forwarded to the processing unit. In this respect, the discharge device can be configured, for example, as a flow diverter or as several flow diverters. Which portion of which FT product is directed into the processing unit is determined by which fuel is the target. It is quite possible that, for example, the oil phase already meets the requirements of a standard as fuel.

The exact configuration of the synthesis unit and the processing unit are to be selected by the person skilled in the art based on the exact products desired. Since the units are known to the person skilled in the art, this is readily possible for the person skilled in the art. In particular, the exact sequence of the processing sub-units and their interconnection can be carried out differently. It is only necessary that the synthesis unit and the processing unit as well as the sub-units are in corresponding operative connections to each other.

Accordingly, in preferred embodiments, the device of the present invention is arranged on one site, preferably in one installation complex, in particular in one housing.

In preferred embodiments, the processing unit comprises at least two, preferably at least three, more preferably all four of said sub-units.

In the present invention, the installation does not comprise a purification device for the gases formed in the processing unit which are recycled to the RWGS of the synthesis unit.

In preferred embodiments of the present invention, the processing unit C) for the processing of wax phase and oil phase, comprises or consists of the following installation parts, wherein the respective installation parts are in operative connection with each other:

C-A) feed lines for a wax phase, an oil phase, hydrogen;
C-B) a hydrocracking reactor unit, which may consist of one or more sub-units, configured for the conversion of wax phase with hydrogen;
C-C) one or more separation units configured for the separation from the product of unit C-B) into
C-Ca) a long chain waxy fraction C-3a),
C-Cc) a short-chain oily fraction C-3c), and
C-Cd) hydrogen or hydrogen-containing gases C-3d);
C-D) a mixing unit configured for the mixing of oil phase with the short-chain oily fraction C-3c),
C-E) one or more separation units configured for the separation of the mixture obtained in the mixing unit C-D) into 5a) a long-chain, waxy fraction,
5c) a short-chain fraction which can be discharged as a product, in particular naphtha,
5d) a medium-chain fraction, comprising
Ea) a return line for the fraction C-5a) to the wax phase,
Ec) a discharge line for C-5c)
Ed) a discharge line for fraction C-5d);
C-F) an isomerization and hydrogenation unit configured for reaction of fraction C-5d) with the addition of hydrogen,
C-G) one or more separation units configured for the separation of the mixture obtained in unit C-F) into
C-Ga) fuel and
C-Gb) hydrogen or hydrogen-containing gases,
wherein the installation is configured to recycle the hydrogen-containing gases formed in C-C) and C-G) to the Fischer-Tropsch synthesis unit B).

It should be noted that the relative designations given in this variant of the present invention, such as shorter chain, etc., are relative to each other within this embodiment. This means that their relation to other embodiments is not necessarily the same; for example, a shorter chain fraction of this embodiment could be short chain or even long chain in relation to another embodiment.

Subject matter of the present invention further is a process for the production of standard-compliant fuels comprising A) providing a $CO_2/H_2$ mixture
B) feeding the $CO_2/H_2$ mixture into a Fischer-Tropsch synthesis unit,
reaction of $CO_2$ and $H_2$ to CO and $H_2$ in an RWGS reaction, wherein $H_2O$ and $CO_2$ may be present as by-products.
reaction of CO and $H_2$ in a Fischer-Tropsch synthesis,
C0) optionally discharging one or more product streams from the Fischer-Tropsch synthesis, and
C) receiving and processing Fischer-Tropsch products discharged from the Fischer-Tropsch synthesis which were not discharged in C0), in particular the wax phase and the oil phase,
with the addition of hydrogen
by
at least one of the following three conversions:
i) isomerization,
ii) cracking, preferably hydrocracking,
iii) hydrogenation,
optionally, but preferably, separation,
discharging of at least one fraction containing a standard-compliant fuel,
optional discharging of aqueous phase, preferably discharging of aqueous phase, and
discharging of gases formed in the processing, comprising hydrogen and $C_1$- to $C_4$-hydrocarbons,
characterized in that the discharging of the formed gases is carried out as recycle into the RWGS, and
in that the gases formed in the processing unit are recycled into the synthesis unit without purification.

In preferred embodiments, the processing of the wax and oil phase discharged from the Fischer-Tropsch synthesis as Fischer-Tropsch products in step C) comprises or consists of the following steps:

Ia) providing the wax phase, optionally in a feed vessel,
II) introducing the wax phase together with hydrogen into a hydrocracking reactor and converting it to shorter chain hydrocarbons
III) separating the product obtained in step II) into
3a) long-chain waxy fraction, which is recycled to Ia),
3c) short-chain oily fraction,
3d) hydrogen or hydrogen-containing gases,
IV) providing an oil phase, optionally in a feed vessel, and mixing the oil phase with the short-chain oily fraction from 3c), optionally with simultaneous, at least partial, degassing,
V) separating the mixture from IV) into
5a) long-chain, waxy fraction, which is recycled to Ia),
5c) short-chain, fraction which can be discharged as a product, in particular naphtha,
5d) medium chain fraction,
VI) conversion of fraction 5d) with the addition of hydrogen in an isomerization and hydrogenation unit,
VII) separation of the product from VI) into
7a) fuel, in particular kerosene, 7b) hydrogen or hydrogen-containing gases, wherein the hydrogen-containing gases formed in steps III) and VII) are recycled.

It should be noted that the relative designations given in this variant of the present invention, such as shorter-chain etc., are in relation to one another within this embodiment. This means that their relation to other embodiments is not necessarily the same; for example, a shorter chain fraction of this embodiment could be short chain or even long chain in relation to another embodiment.

In one embodiment, the present invention relates to a process for producing standard-compliant fuels from a wax phase, an oil phase, which in this embodiment are preferably FT products but may also be derived from other sources, and hydrogen, comprising the following steps or consisting thereof:

Ia) providing a wax phase, optionally in a feed vessel, wherein this corresponds to a direct conversion from the product stream of a PtL or introduction into a feed tank, II) introducing the wax phase together with hydrogen into a hydrocracking reactor and reacting to shorter chain hydrocarbons.

III) separating the product obtained in step II) into 3a) long-chain waxy fraction, which is recycled to Ia), 3c) short-chain oily fraction, 3d) hydrogen or hydrogen-containing gases, IV) providing an oil phase, optionally in a feed vessel, wherein this corresponds to a direct conversion from the product stream of a PtL or introduction into an oil feed tank and mixing the oil phase with the short-chain, oily fraction from 3c), optionally with simultaneous, at least partial, degassing, V) separating the mixture from IV) into 5a) long-chain, waxy fraction, which is recycled to Ia), 5c) short-chain, fraction which can be discharged as a product, in particular naphtha, 5d) medium chain fraction, VI) reaction of fraction 5d) with the addition of hydrogen in an isomerisation and hydrogenation unit, VII) separation of the product from VI) into 7a) fuel, in particular kerosene, 7b) hydrogen or hydrogen-containing gases, wherein the hydrogen-containing gases formed in steps III) and VII) are recycled and added to the educt hydrogen stream.

It should be noted that the relative designations given in this variant of the present invention, such as shorter chain, etc., are relative to each other within this embodiment. This means that their relation to other embodiments is not necessarily the same; for example, a shorter chain fraction of this embodiment could be short chain or even long chain in relation to another embodiment.

In this variant of the present invention, step III) may comprise the separation of the product obtained in step II) in a hot separator into a long-chain waxy fraction 3a), which is recycled to Ia), and a shorter-chain oily fraction 3b), and optionally a further separation of the shorter-chain fraction in a cold separator into a short-chain oily fraction, and hydrogen or hydrogen-containing gas, which is recovered.

In this variant of the present invention, moreover, step V) may comprise the separation of the product obtained in step IV) in a first separation unit into a long-chain waxy fraction 5a), which is recycled in Ia), and a shorter-chain, more oily fraction 5b), and optionally a further separating of the shorter-chain fraction in a second separation unit into a short-chain oily product fraction 5c), in particular naphtha, and a medium-chain fraction 5d).

Also in this variant of the present invention, the separation in step VII) may be carried out in a cold separator.

Further in this variant of the present invention, the hydrogen or hydrogen-containing gas(es) formed in steps III) and VII) is/are recycled without further processing, in particular without purification, and added to the educt hydrogen stream. This means that the recycled gas stream can also comprise short-chain hydrocarbons, in particular $C_1$- to $C_4$-hydrocarbons.

Likewise, in this variant of the present invention, the oil phase and the wax phase may be products from a Fischer-Tropsch synthesis.

Furthermore, in this variation of the present invention, the wax phase and the oil phase may be derived from a power-to-liquid process, preferably a Fischer-Tropsch synthesis based power-to-liquid process.

In one embodiment of the present invention, the processing unit C) for receiving and processing the products coming from the Fischer-Tropsch synthesis unit may comprise or consist of the following installation parts, wherein the respective installation parts are in operative connection with each other:

C-A) feed lines for

C-Aa) a wax phase,

C-Ab) an oil phase,

C-Ac) hydrogen;

C-B) a hydrocracking reactor unit, which may consist of one or more sub-units, configured for the conversion of wax phase with hydrogen;

C-C) one or more separation units configured for the separation of from the product of unit C-B) into C-Ca) a long chain waxy fraction C-3a), C-Cc) a short-chain oily fraction C-3c), and C-Cd) hydrogen or hydrogen-containing gases C-3d);

C-D) a mixing unit configured for the mixing of oil phase with the short-chain oily fraction C-3c), C-E) one or more separation units configured for the separation of the mixture obtained in the mixing unit C-D) into C-5a) a long-chain, waxy fraction C-5c) a short-chain fraction which can be discharged as a product, in particular naphtha, C-5d) a medium-chain fraction, comprising C-Ea) a recycle line for the fraction C-5a) to the wax phase, C-Ec) a discharge line for C-5c)

C-Ed) a discharge line for the fraction C-5d);

C-F) an isomerization and hydrogenation unit configured for the conversion of fraction C-5d) with the addition of hydrogen, C-G) one or more separation units configured for the separation of fraction C-5d) into C-Ga) fuel and C-Gb) hydrogen or hydrogen-containing gases, wherein the unit is configured to recycle the hydrogen-containing gases formed in C-C) and C-G) and to add them to the educt hydrogen stream or directly to the RWGS without further processing.

It should be noted that the relative designations given in this embodiment of the present invention, such as shorter chain, etc., are relative to each other within this embodiment. This means that their relation to other embodiments is not necessarily the same; for example, a shorter chain fraction of this embodiment could be short chain or even long chain in relation to another embodiment.

It should also be noted that the processing unit of this embodiment may replace that of the embodiments described above with sub-features C1), C2), C3) and C4).

In this embodiment of the present invention, C-C) may comprise or consist of two separation units, wherein the first separation unit, preferably a hot separation unit, is configured for separating the product from unit C-B) into a long-chain waxy fraction C-3a) and a shorter-chain, oilier fraction C-3b), and wherein the second separator unit, preferably a cold separator unit, is configured for separating the shorter-chain fraction from the first separator unit into a short-chain, oily fraction C-3c), and hydrogen or hydrogen-containing gas C-3d). Here, the separation units are configured such that the long-chain waxy fraction is recycled from the first separation unit to the wax phase.

In this embodiment of the present invention, moreover, C-E) may comprise or consist of two separation units, wherein a first separation unit is configured for separating the mixture obtained in mixing unit C-D) into a long-chain waxy fraction C-5a), and a shorter-chain, oilier fraction C-5b), and a second separation unit is configured for further separating the fraction C-5b) into a short-chain, oily product fraction C-5c), in particular naphtha, and a medium-chain fraction C-5d). Here, the separation units are configured such that the long-chain, waxy fraction is recycled from the first separation unit to the wax phase.

In this and all further variations of the processing units according to the invention, C-G) may be configured as a separator, preferably a cold separator.

In the context of the present invention, the processing units are configured such that the hydrogen or hydrogen-containing gas(es) formed in C-C) and C-G) is/are recycled without further processing, in particular without purification, and is/are added either to the educt hydrogen stream or to a RWGS installation without further processing.

In embodiments of the present invention, a hydrogen feed line may be arranged in the Fischer-Tropsch synthesis unit between the RWGS stage and the Fischer-Tropsch stage in the installation according to the invention.

Accordingly, in embodiments of the present invention, a hydrogen feed may be provided in the process according to the invention between the conversion of $CO_2$ and $H_2$ to CO and $H_2$, which takes place in a RWGS reaction, and the conversion of CO and $H_2$ in a Fischer-Tropsch synthesis.

In particular, the processing unit according to the invention is coupled to a power-to-liquid installation, in particular to a power-to-liquid installation based on a Fischer-Tropsch synthesis, in such a way that the wax phase and the oil phase originate from the products from the power-to-liquid installation.

An advantage of the present invention is that no purification of the gas is required to feed the gas mixture into the RWGS of the synthesis gas production.

An advantage of the present invention is that the hydrogen requirement necessary for a PtL installation and the hydrogen requirement necessary in total for both process steps, i.e. in the PtL process and the refining, are reduced.

It was surprisingly found that the recycling of the hydrogen containing gases from the hydrotreatment without further processing into the RWGS is possible, although a high $H_2$/CO ratio results from the high content of hydrogen in these gases.

A particular advantage of the present invention is that by the specific setting of the parameters in the individual process steps or in the individual parts of the device it is made possible to produce standard-compliant fuels respectively.

How exactly the parameters are to be set in each case is known to the person skilled in the art on the basis of his general technical knowledge and is carried out on the basis of the desired target products.

In that it is particularly advantageous that in the context of the present invention one is not bound to existing standards, for example but not exclusively those mentioned above, but can react flexibly to changing standards and adapt the process and device parameters in order to also fulfil the changed standards and their specifications. Insofar as parts or the entire installation are marked as "consisting of" in the description of the installation according to the invention, this is to be understood as referring to the essential components mentioned. Self-evident or inherent parts such as pipes, valves, screws, housings, measuring devices, storage tanks for educts/products etc. are not excluded by this. Preferably, however, other essential components, as would be additional reactors or the like, which would change the process flow, are excluded.

The various embodiments of the present invention, e.g.—but not exclusively—those of the various dependent claims, may thereby be combined with each other in any desired manner, provided that such combinations do not contradict each other.

BRIEF DESCRIPTION OF THE DRAWINGS

The present invention is explained in more detail below with reference to the drawings. The drawings are not to be construed as limiting and are not to scale. Furthermore, the drawings do not contain all the features that are present in usual installations, but are reduced to the features that are essential for the present invention and its understanding.

FIG. 2*a* shows an installation of the prior art;

DETAILED DESCRIPTION OF EMBODIMENTS OF THE INVENTION

Examples

Figure 1:
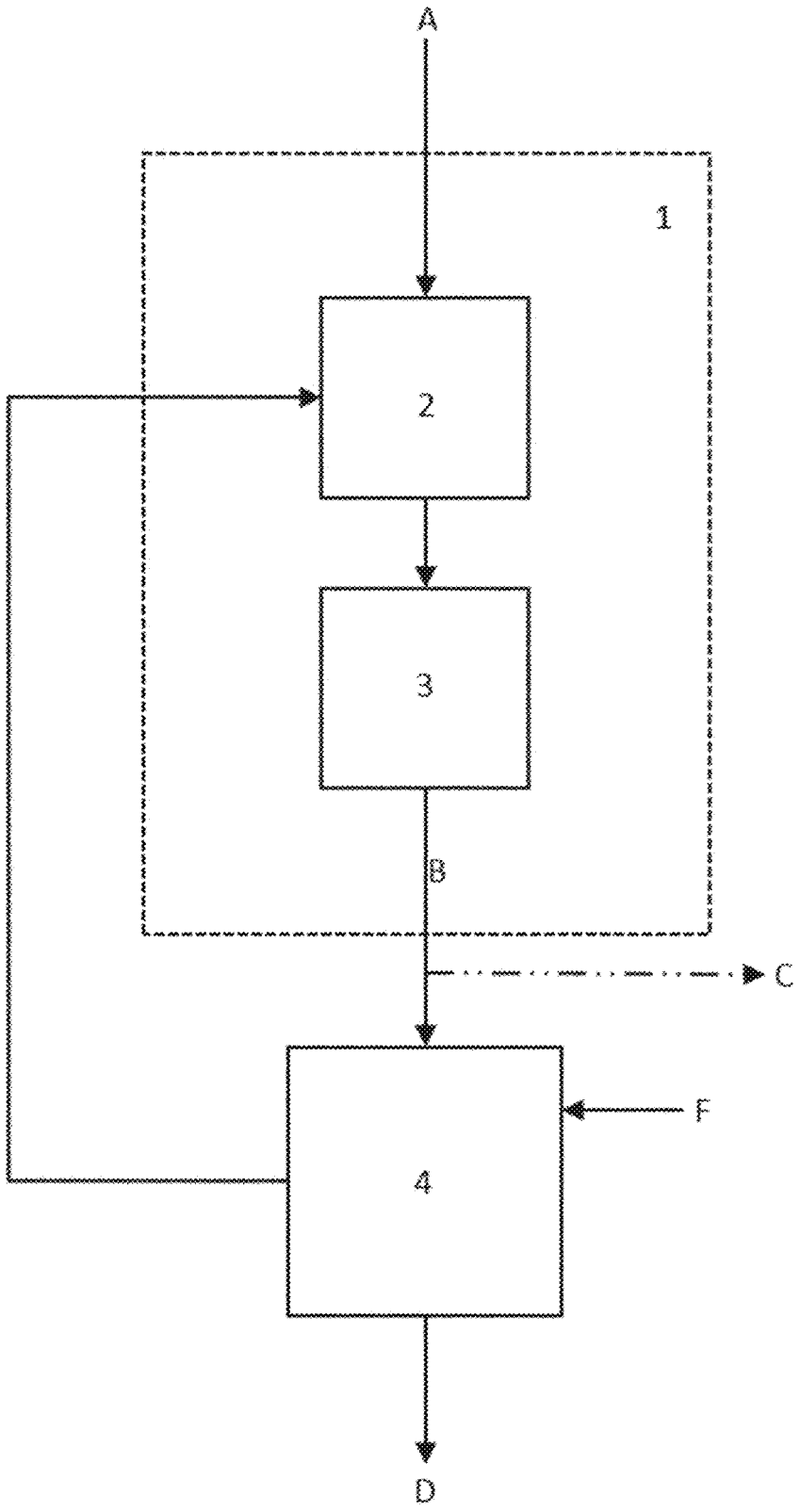
FIG. 1 shows schematically an installation of the invention.

The invention will now be further explained with reference to the following non-limiting examples.

Example 1

In a spatial separation of production of hydrocarbons that are liquid at room temperature (FT-oil) and solid hydrocarbons (FT-wax), there is a demand for hydrogen both at the PtL site and at the downstream processing site (e.g., a refinery).

As an example, the demand was normalized to an input flow of one tonne of $CO_2$ per hour.

The synthesis unit at the PtL site then requires an hourly hydrogen feed of 127 kg to produce the FT products. The processing on the refinery side then requires a further 36.6 kg per hour, in sum that is 163.6 kg of hydrogen per hour.

With spatial separation of the PtL site and the refinery, as in the prior art, these hydrogen quantities are always required because hydrogen formed on the refinery side during processing is discharged and disposed of, with a quantity of 27.3 kg per hour.

In contrast, in the present invention there is no spatial separation, and the hydrogen formed during reprocessing is recycled into the synthesis unit. Thus, the aforementioned 27.3 kg per hour from the processing unit is not lost in the present invention, so that the continuous feed of fresh (new) hydrogen into the synthesis unit need only be 99.7 kg per hour.

Accordingly, with the same production capacity of the PtL installation, by the present invention an integration of the processing steps at the PtL site can be done, in order to thus reduce the overall hydrogen demand and to enable direct production of standard-compliant fuels at the PtL site.

By the $H_2$ management on which this invention is based thus the hydrogen demand necessary for the PtL installation can be reduced and the total hydrogen demand necessary for both process steps be lowered.

A comparison of these data shows that of a total hydrogen demand of 163.6 kg/h hydrogen (127+36.6) per 1000 kg/h $CO_2$ in the prior art, 27.3 kg/h must be discharged and disposed of unused, which are recycled and continued to be used in the present invention. In this respect, the present invention achieves a hydrogen saving of about 17%.

Example 2

A process according to the invention was carried out using the following characteristics:

Temperature during RWGS: 740° C.

Temperature during FT synthesis: 240° C.

Temperature during separation: 190° C.

Pressure 20 bar

Proportion of recycled gases (in steady-state operation): 18 vol. %.

Accordingly, a $CO_2/H_2$ mixture was provided and fed into a Fischer-Tropsch synthesis unit, where at first a conversion of $CO_2$ and $H_2$ to CO and $H_2$ in a RWGS reaction occurred and then a conversion of CO and $H_2$ in a Fischer-Tropsch synthesis.

The gases formed after the processing of the products obtained from Fischer-Tropsch synthesis, comprising $C_1$- to $C_4$-hydrocarbons, were fed back directly into the RWGS as a recycling stream without purification (the exact type of processing of the FT products is not given, as it is not relevant for this example; in this example, only the gases formed are important).

Figure 4:
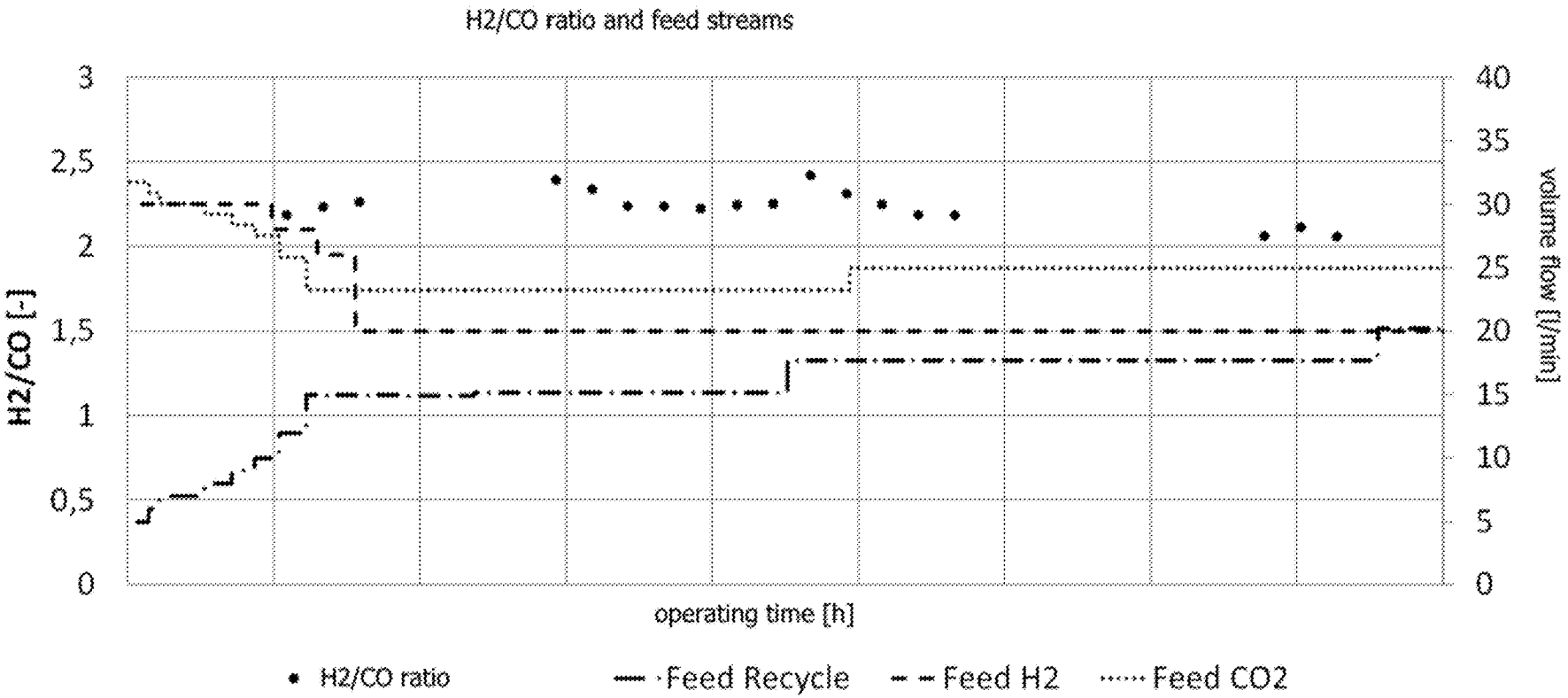
FIG. 4 shows a graphical plotting of the material flows according to Example 2 below.

The supply of hydrogen was controlled during operation depending on the proportion of recycled gas; i.e. as the amount of recycled gas increases, correspondingly less hydrogen is added. The corresponding quantities are shown in FIG. 4, where the hydrogen feed is represented by a dashed line and the recycled stream by a chain line (see also the legend of FIG. 4).

Since the recycled gas contains a proportion of $C_1$- to $C_4$-hydrocarbons, the carbon dioxide feed was also changed accordingly depending on the amount of recycled gas. The amount of carbon dioxide feed is represented by a dotted line in FIG. 4.

The ratio of $H_2$ to CO was determined by taking gas chromatographic measurements of the product stream of the RWGS. The measured values obtained for the ratio of $H_2$ to CO are shown as dots in FIG. 4.

As a result, it was found in this example that an increasing proportion of recycle gas does not significantly change the $H_2/CO$ ratio.

FIG. 1 shows schematically the present invention. $CO_2$ and $H_2$ as feed gas A are converted into Fischer-Tropsch products in a synthesis unit 1. In the example shown, the synthesis unit 1 schematically consists of an RWGS 2 and the actual Fischer-Tropsch installation 3. In the RWGS 2, $CO_2$ and $H_2$ are converted to synthesis gas, i.e. to CO and $H_2$, whereby the by-products $CO_2$ and $H_2O$ can also be present in the product gas. CO and $H_2$, in turn, are then converted in the FT installation 3 to a product mixture B of gas phase consisting of non-converted synthesis gas (mainly CO, $H_2$), short-chain hydrocarbons and volatile components of the by-products as well as $CO_2$, a waxy phase of long-chain hydrocarbons that is solid at ambient temperature and pressure (wax phase), a hydrophobic phase of shorter-chain hydrocarbons (oil phase) which is liquid at ambient temperature and ambient pressure, and an aqueous phase of reaction water forming and organic compounds dissolved therein. This product mixture B (FT product) is then fed into the processing unit 4. As indicated in the figure, it is possible to branch off a part of the FT product B in the process. This branched-off part C can comprise entireties of the four phases mentioned or only parts. For example, it is possible to branch off a part of the oil phase or the entire oil phase, if this phase is intended for a specific use, and to feed the remainder into the processing unit 4. In the processing unit 4, the FT product B can then be processed by carrying out isomerisation, cracking, hydrogenation and separation/separation. For this purpose, hydrogen is fed F to the processing unit 4. At least one standard-compliant liquid fuel D is then discharged from the processing unit 4. The hydrogen-containing gas stream E formed in the processing unit 4, which may still contain $C_1$- to $C_4$-hydrocarbons, is recycled to the synthesis unit 1, there the RWGS unit 2, without further purification. By the recycling of the hydrogen-containing stream E, considerably less hydrogen is required than in a procedure according to the state of the art.

FIG. 2*a* shows the previous state of the art. In contrast to the present invention, the PtL site and the refinery are locally separated from each other (symbolised by two dashed boxes, the upper one representing the PtL site, the lower one the refinery). In the upper box the PtL site is illustrated, to which a synthesis unit 1 according to FIG. 1 is located, and in the upper box the refinery, where a processing unit 4 according to FIG. 1 is located. Hydrogen A1 and carbon dioxide A2 are introduced into the synthesis unit and as products (among others) oil phase B1 and wax phase B2 are obtained. These two phases B1 and B2 are processed in the processing unit 4 and the product D is obtained. According to the state of the art, as illustrated in FIG. 2*a*, due to the spatial separation of the PtL site and the refinery, there is no equipment connection between synthesis unit 1 and reprocessing unit 4. As a result, all of the hydrogen A1 required for synthesis unit 1 must be made available on site at the PtL site and, in addition, all of the hydrogen A1-II required for processing must be made available at the refinery site. Furthermore, the hydrogen formed during processing must be discharged and disposed of (e.g. incinerated) via a discharge line G at the refinery site.

Figure 2B:
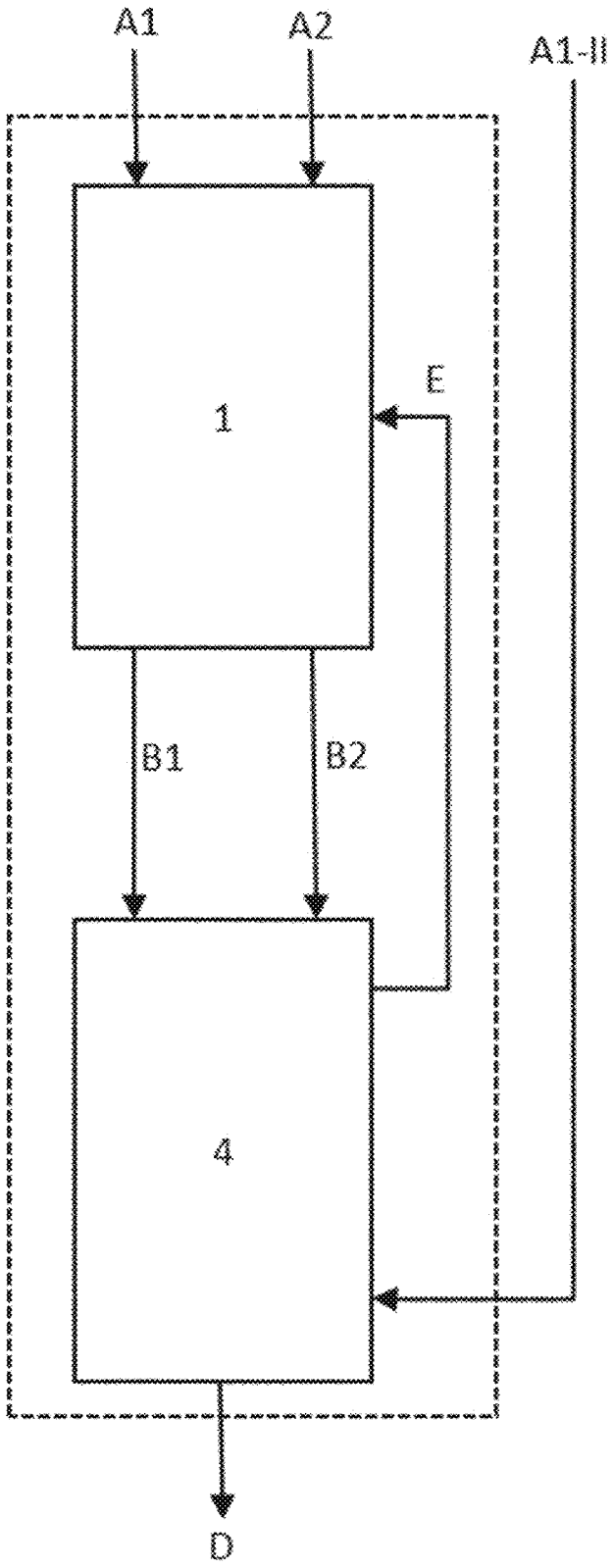
FIG. 2*b* shows the same basic set-up as FIG. 2*a*, but in the arrangement according to the present invention.

FIG. 2*b* shows the same basic set-up as FIG. 2*a*, but in the arrangement according to the present invention. The basic reactions that take place in the units are essentially the same, as are the gas flows supplied to and discharged from the respective units. The difference to the prior art, however, is that the PtL site in addition to the synthesis unit 1 includes the processing unit 4, and this is not at a different location, the refinery (symbolised by a large dashed box encompassing both units). This makes it possible to recycle the hydrogen formed in the processing unit 4 directly into the synthesis unit as a recycling stream E. This has two enormous advantages: on the one hand, it reduces the amount of hydrogen required and on the other hand, the hydrogen formed during processing does not have to be disposed of. Thus, enormous ecological, economic and technical advantages are achieved.

A comparison of FIGS. 2*a* and 2*b* shows that of a total hydrogen demand of 163.6 kg/h hydrogen (127+36.6) per 1000 kg/h $CO_2$ according to the state of the art 27.3 kg/h must be discharged and disposed of unused, which is recycled and continued to be used in the present invention. In this respect, by the present invention a hydrogen saving of around 17% is achieved.

Figure 3:
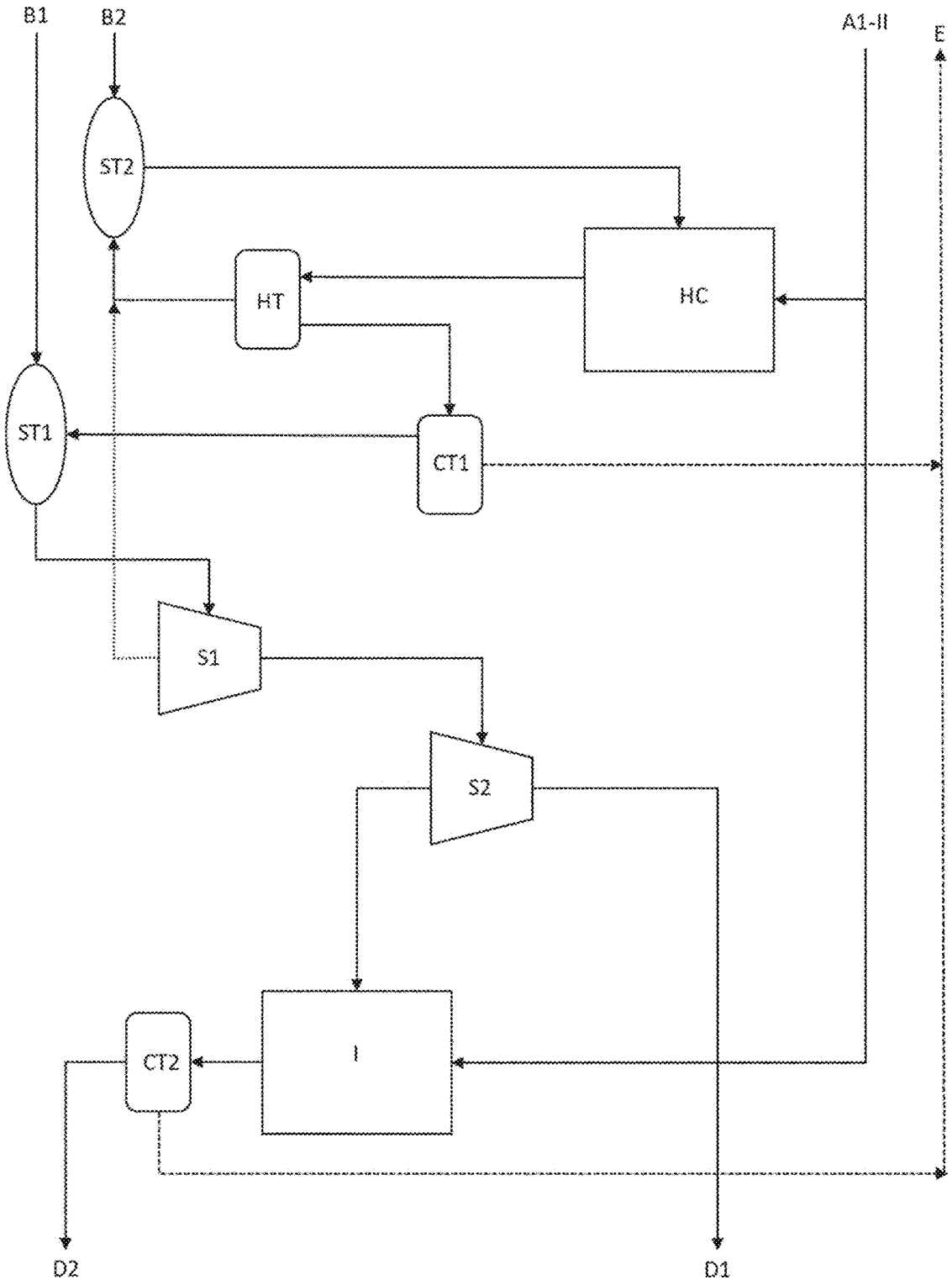
FIG. 3 shows a possible variant of the processing of the Fischer-Tropsch products.

FIG. 3 shows a possible variant of the processing of the FT products.

In this example, both the wax phase B2 and the oil phase B1 are temporarily stored in storage tanks ST2/ST1. The oil phase B1 can be degassed in the storage vessel ST1 (at any time), if this becomes necessary (not shown). The wax phase B2, or a certain portion thereof, is then fed into a hydrocracking reactor HC where it is converted with feeding of hydrogen from the hydrogen supply A1-II. The product then enters a hot separator HT, where a separation takes place and one phase is fed back into the storage vessel ST2 and the other further into a cold separator CT1. In the cold separator CT1, a separation takes place into a gas stream containing hydrogen, which is recycled as recycling stream E, and a fraction, which is fed into the aforementioned storage vessel ST1 of the oil phase B1. From this storage vessel ST1, the mixture of substances is fed into a separation unit S1. The bottom product obtained there is returned to the storage vessel ST2 for the wax phase and the head product is fed on into another separation unit S2. In this example, its head product is discharged as naphtha, i.e. as product D1. The bottom product of the second separation unit S2 is in this example fed into an isomerisation reactor I, where it is converted with the addition of hydrogen from the hydrogen supply A1-II. The product thus obtained is passed to a cold separator CT2, where a separation into hydrogen-containing gas—which is recycled as recycling stream E—and fuel, which is discharged as product D2, takes place.

It should be noted that the arrangement of the installation components shown in FIG. 3 is only one possibility, but it is not the only one.

FIG. 4 shows a graphical plotting of the material flows according to Example 2.

LIST OF REFERENCE SIGNS

1 synthesis unit
2 RWGS unit
3 FT installation
4 processing unit
A gas supply containing hydrogen and carbon dioxide gas
A1 hydrogen supply
A2 carbon dioxide supply
A1-II hydrogen supply for processing
B FT product
B1 oil phase
B2 wax phase
C finished FT product (directly from 1)
D product (standard-compliant fuel)
D1 naphtha
D2 JetFuel (fuel)
E recycling stream containing hydrogen and $C_1$- to $C_4$-hydrocarbons
G hydrogen discharge
I isomerization unit
S1 separation unit 1
S2 separation unit 2
CT1 cold separator 1
CT2 cold separator 2
HC hydrocracking reactor
HT hot separator
ST1 storage tank 1
ST2 storage tank 2

What is claimed is:

1. An installation for the production of standard-compliant fuels, wherein the installation comprises A) an optional unit for providing a $CO_2/H_2$ mixture B) a Fischer-Tropsch synthesis unit comprising or consisting of:

at least one RWGS (Reverse Water Gas Shift Reaction) stage configured for a reaction of $CO_2$ and $H_2$ to synthesis gas, at least one Fischer-Tropsch stage configured for a reaction of CO and $H_2$ in a Fischer-Tropsch synthesis, C0) optionally at least one discharge device for product streams originating from the Fischer-Tropsch synthesis, C) a processing unit configured for receiving and processing Fischer-Tropsch products discharged from the Fischer-Tropsch synthesis unit, comprising or consisting of at least one of the following three subunits:

i) an isomerization unit, ii) a cracking unit iii) a hydrogenation unit, optionally at least one separation unit, at least one feed line for hydrogen, one or more discharge lines, each configured for a discharge of a fraction containing a standard-compliant fuel in each case, optionally one discharge line for an aqueous phase, and at least one discharge line for formed gases comprising hydrogen and $C_1$- to $C_4$-hydrocarbons, the at least one discharge line for the formed gases being designed as a recycle line for the gases into the RWGS stage, and wherein the installation does not have a purification device for the gases formed in the processing unit which are recycled to the RWGS stage.

2. The installation of claim 1, wherein the Fischer-Tropsch products discharged from the synthesis unit comprise a wax phase and an oil phase.

3. The installation of claim 1, wherein cracking unit ii) is a hydrocracking unit.

4. The installation of claim 1, wherein the installation is arranged on a single site.

5. The installation of claim 1, wherein the installation is arranged in a single housing.

6. The installation of claim 1, wherein the processing unit comprises at least two of the units i), ii) and iii).

7. The installation of claim 1, wherein the processing unit comprises all three of the units i), ii) and iii).

8. The installation of claim 1, wherein the installation is configured to produce at least one of kerosene, diesel or gasoline as a product.

9. The installation of claim 1, wherein the processing unit C) for the processing of wax phase and oil phase comprises or consists of the following installation parts, the respective installation parts being in operative connection with each other:

C-A) feed lines for
- C-Aa) a wax phase,
- C-Ab) an oil phase,
- C-Ac) hydrogen;

C-B) a hydrocracking reactor unit, which may consist of one or more sub-units, configured for the reaction of wax phase with hydrogen;

C-C) one or more separation units configured for separation of product of unit C-B) into
- C-Ca) a long chain waxy fraction C-3a),
- C-Cc) a short-chain oily fraction C-3c), and
- C-Cd) hydrogen or hydrogen-containing gases C-3d);

C-D) a mixing unit configured for mixing of oil phase with the short-chain oily fraction C-3c), C-E) one or more separation units configured for separating a mixture obtained in mixing unit C-D) into
- 5a) a long-chain, waxy fraction,
- 5c) a short-chain, fraction which can be discharged as a product,
- 5d) a medium-chain fraction, comprising
- Ea) a return line for fraction C-5a) to the wax phase,
- Ec) a discharge line for fraction C-5c)
- Ed) a discharge line for fraction C-5d);

C-F) an isomerization and hydrogenation unit configured for reacting fraction C-5d) with addition of hydrogen, C-G) one or more separation units configured for separating a mixture obtained in unit C-F) into
- C-Ga) fuel and
- C-Gb) hydrogen or hydrogen-containing gases, the installation being configured to recycle hydrogen-containing gases formed in C-C) and C-G) into the RWGS stage of Fischer-Tropsch synthesis unit B).

10. The installation of claim 1, wherein a hydrogen feed line is arranged in Fischer-Tropsch synthesis unit B) between the RWGS stage and the Fischer-Tropsch stage.

11. A process for the production of standard-compliant fuels, wherein the process comprises:

A) providing a $CO_2/H_2$ mixture,

B) feeding the $CO_2/H_2$ mixture into a Fischer-Tropsch synthesis unit,
- reaction of $CO_2$ and $H_2$ to CO and $H_2$ in a RWGS reaction,
- reaction of CO and $H_2$ in a Fischer-Tropsch synthesis, C0) optionally discharging one or more product streams from the Fischer-Tropsch synthesis, and C) receiving and processing Fischer-Tropsch products discharged from the Fischer-Tropsch synthesis which were not discharged in C0),
- with the addition of hydrogen
- by
- at least one of the following reactions:
  - i) isomerization,
  - ii) cracking
  - iii) hydrogenation,
- optionally separation,
- discharging of at least one fraction containing a standard-compliant fuel,
- optionally discharging of aqueous phase, and
- discharging of gases formed in processing, comprising hydrogen and $C_1$- to $C_4$-hydrocarbons, the discharging of gases formed in processing being carried out as recycle into the RWGS reaction, and the gases formed in the processing unit being recycled to the RWGS reaction without purification.

12. The process of claim 11, wherein processing of wax and oil phase discharged from the Fischer-Tropsch synthesis as Fischer-Tropsch products in C) comprises or consists of:

Ia) providing the wax phase, optionally in a feed vessel,

II) introducing the wax phase together with hydrogen into a hydrocracking reactor and converting the wax phase into shorter chain hydrocarbons, III) separating product obtained in II) into
- 3a) a long-chain waxy fraction, which is recycled to Ia),
- 3c) a short-chain oily fraction,
- 3d) hydrogen or hydrogen-containing gases, IV) providing an oil phase, optionally in a feed vessel, and mixing the oil phase with the short-chain oily fraction from 3c), optionally with simultaneous, at least partial, degassing, V) separating a mixture obtained in IV) into
- 5a) a long-chain, waxy fraction, which is recycled to Ia),
- 5c) a short-chain fraction which can be discharged as a product,
- 5d) a medium chain fraction, VI) reaction of fraction 5d) with addition of hydrogen in an isomerization and hydrogenation unit, VII) separation of product from VI) into
- 7a) fuel
- 7b) hydrogen or hydrogen-containing gases, the hydrogen-containing gases formed in III) and VII) being recycled.

13. The process of claim 11, wherein all process steps are carried out on a single site.

14. The process of claim 11, wherein all process steps are carried out in a single housing.

15. The process of claim 11, wherein C) comprises at least two of reactions i), ii) and iii).

16. The process of claim 11, wherein C) comprises all three reactions i), ii) and iii).

17. The process of claim 11, wherein the process is carried out such that at least one of kerosene, diesel or gasoline is obtained as a product.

18. The process of claim 11, wherein in B) a hydrogen feed is performed between a reaction of $CO_2$ and $H_2$ to CO and $H_2$, in a RWGS reaction, and a reaction of CO and $H_2$ in a Fischer-Tropsch synthesis.

* * * * *